US006594867B1

(12) United States Patent
Pettersson

(10) Patent No.: US 6,594,867 B1
(45) Date of Patent: Jul. 22, 2003

(54) DEVICE AT A BUNDLE TIE

(75) Inventor: Stefan Pettersson, Gotene (SE)

(73) Assignee: Gepe Development AG, Zug (CH)

( * ) Notice: Subject to any disclaimer, the term of this patent is extended or adjusted under 35 U.S.C. 154(b) by 0 days.

(21) Appl. No.: 10/088,777

(22) PCT Filed: Sep. 19, 2000

(86) PCT No.: PCT/SE00/01809

§ 371 (c)(1),
(2), (4) Date: Mar. 20, 2002

(87) PCT Pub. No.: WO01/21500

PCT Pub. Date: Mar. 29, 2001

(30) Foreign Application Priority Data

Sep. 21, 1999 (SE) ..... 9903378

(51) Int. Cl.[7] ..... B65D 63/10
(52) U.S. Cl. ..... 24/16 PB; 24/30.5 P
(58) Field of Search ..... 24/16 R, 16 PB, 24/30.5 P, 17 A, 17 AP; 248/74.3

(56) References Cited

U.S. PATENT DOCUMENTS

| | | | | | |
|---|---|---|---|---|---|
| 3,147,522 | A | * | 9/1964 | Schumm | 24/16 PB |
| 3,206,813 | A | * | 9/1965 | Schumm | 24/16 PB |
| 3,206,814 | A | * | 9/1965 | Schumm | 24/20 TT |
| 3,837,047 | A | * | 9/1974 | Bunnell | 24/16 PB |
| 4,788,751 | A | | 12/1988 | Shely et al. | |
| 5,363,536 | A | * | 11/1994 | Kleeman, deceased | 24/30.5 P |
| 5,970,585 | A | * | 10/1999 | Scholey | 24/482 |
| 6,226,839 | B1 | * | 5/2001 | Sayegh | 24/16 PB |

FOREIGN PATENT DOCUMENTS

| | | | | |
|---|---|---|---|---|
| EP | 893360 A1 | * | 1/1999 | B65D/63/10 |
| GB | 1528097 A | * | 10/1978 | B65D/63/10 |
| JP | 09210020 A | * | 8/1997 | F16B/2/08 |
| WO | WO- 9618554 | | 6/1996 | |
| WO | WO 9618554 A1 | * | 6/1996 | B65D/63/10 |
| WO | WO 9721606 A1 | * | 6/1997 | B65D/63/10 |
| WO | WO 9918005 A1 | * | 4/1999 | B65D/63/16 |

* cited by examiner

*Primary Examiner*—James R. Brittain
(74) *Attorney, Agent, or Firm*—Merchant & Gould P.C.

(57) ABSTRACT

The invention relates to a device in a cable tie. This comprises an elongated tie part (2) of a certain width and thickness, which at one end has an elongated insertion part (3) of lesser width than the tie part (2) and at its other end a locking head (1). In the latter there is, on the one hand, a through-opening (6) intended for tie part (2) and having a width substantially the same as the tie part (2) but a height greater than the thickness of the tie part (2), and on the other, in one transverse wall of the opening (6), a groove-shaped recess (7). The width of the recess (7) is such that it allows the insertion part (3) to be inserted into the opening (6) via the recess (7) forming a tie loop. Interacting members are provided on the tie part (2) and in the locking head (1) that are designed by positive interlocking engagement with one another to lock the tie part (2) relative to the locking head (1). At each edge of tile recess (7) there is furthermore a pin-shaped projection (11) pointing towards the through-opening (6) and designed to engage with corresponding grooves (12) running along each edge of the tie part (2) when tile tie part (2) is inserted into tile opening (6).

1 Claim, 2 Drawing Sheets

DEVICE AT A BUNDLE TIE

The present invention relates to a device in a cable tie according to the pre-characterising clause of the attached claim.

A cable tie of this type is described in more detail in SE 510 655.

In this cable tie the tightening force at which the head part is no longer capable of holding the tie part is largely determined by the wall thickness of the head part. Particularly disadvantageous in this context is the fact that the head part has a groove-shaped recess, which although it facilitates the introduction of the tie part nevertheless involves a weakening of the head part.

There is therefore a desire here to achieve a strong locking force with a relatively thin-walled and slender locking head.

U.S. Pat. No. 3,837,047 discloses a moulded plastics cable tie, which is designed so that it can be produced by a normal moulding process, in which the moulded parts and any inserts move in the same directions, that is across one another. A section of the cable tie is designed with locking flanges along the edges, which flanges extend upward and downward, that is to say out from both sides of the tie. When the said section of the cable tie is inserted into the locking head the cable tie forms a bridge-like reinforcement in the locking head due to the positive interlocking engagement between the locking flanges and parts in the locking head of complementary shape. The locking flanges give the cable tie greater thickness and flexural rigidity, which may limit the flexibility of the cable tie and thereby constitute a disadvantage when tying thin cable bundles.

The object of the present invention in cable ties of the said type is to produce a device, which appreciably increases the force that is required in order to forcibly break open the cable tie, whilst preserving the pliability and serviceability of the cable tie even when tying thin cable bundles. This is achieved by the means indicated in the characterising part of the claim.

Figure 1:
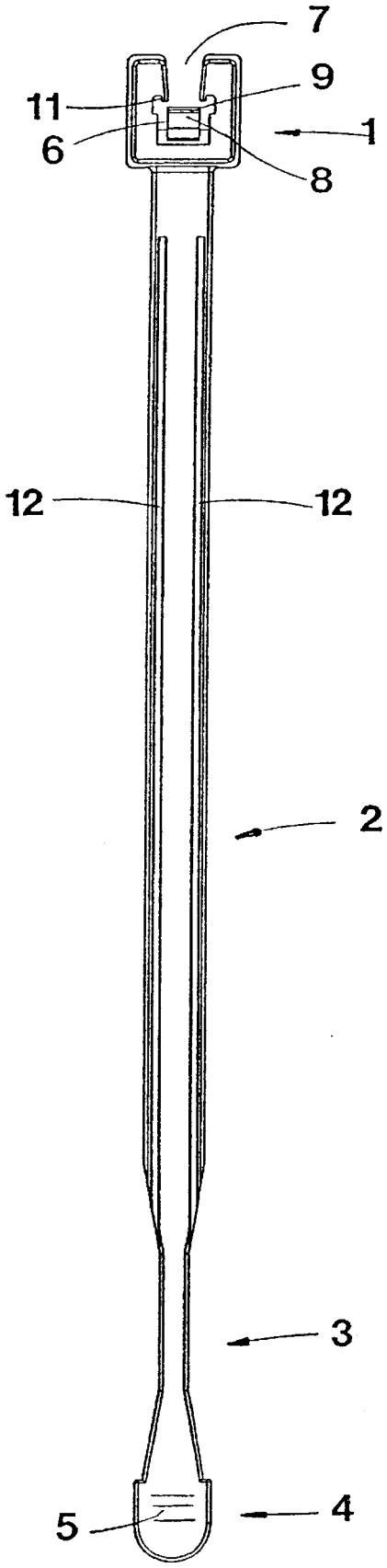

The invention will be explained in more detail below with reference to the drawing attached, in which FIG. 1 in a diagrammatic plan view shows a cable tie according to the invention.

Figure 2:
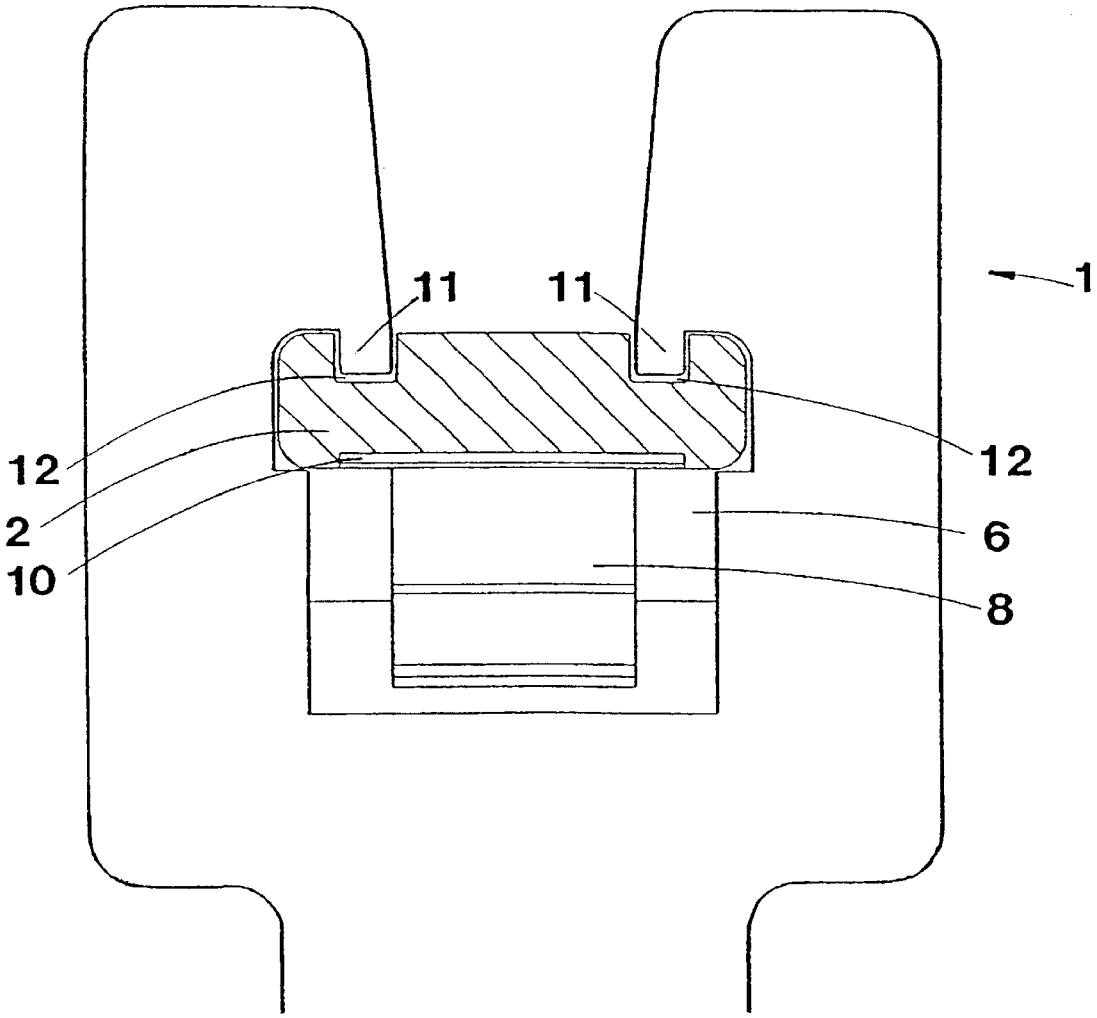

FIG. 2 shows the head part of the cable tie to a larger scale, with tie part inserted.

The embodiment of a cable tie according to the present invention shown in the drawing contains a head part 1, a tie part 2, an insertion part 3 of lesser width than the tie part 2 and an end part 4 serving as grip tab. The length of the tie part 2 is in principle arbitrary as is the length of the insertion part 3, which is at least as long as the head 1. The end part 4 has a greater width than the tie part 2 and is provided on at least one side with transverse ridges 5 to facilitate gripping of the part when tensioning the tie around a cable bundle or the like, for example.

The head 1 is provided with a through-opening 6, which extends in the longitudinal direction of the head 1 and across the tie parts 2–4. A groove-shaped recess 7 extends through the upper wall of the head and has a width adapted to receive the insertion part 3, together with outwardly bevelled edges, which may also be regarded as guide edges for guiding the insertion part 3 down into the through-opening 6. Arranged in the latter is a locking member in the form of a tongue 8. This proceeds from the bottom of the through-opening 6 and extends largely diagonally towards the opposite end of the opening 6 and towards the groove-shaped recess 7. On the side facing the groove-shaped recess 7 the tongue 8 is provided with a number of ratchet teeth 9, which are intended to interact with corresponding ratchet teeth 10 on the tie part 2. After threading the insertion part 3 into the through-opening 6 on top of the tongue 8, as shown in FIG. 2, this will be pressed down against the bottom of the through-opening 6 and will then spring back in order to secure the engagement between the teeth 9 and 10. It should be noted in particular that the shape of the tongue and the fastening position in the opening 6 mean that the engagement between the teeth 9 and 10 (increases with increasing tensile force in the tie part 2.

The end part 4 has a further important function. Due to the fact that its width prevents it escaping out through the opening 6, it is easily possible, by bringing the insertion part 3 down in the recess 7, to produce a loop, which loosely surrounds a bundle of cables, for example. Further cables may be introduced through the said loop as required before the cable tie is tightened.

According to the invention a projection 11 pointing in towards the through-opening 6 is provided on respective edges of the recess 7. A groove 12 runs along each edge of the tie part 2. The projections 11 are designed, when the tie part 2 is inserted into the opening 6, to engage with the grooves 12. Locking of the walls of the head 1 is thereby achieved by means of the tie part 2, so that the said walls are held together even under relatively high tensioning forces, that is to say the width of the recess 7 remains unaltered. Secure locking of the cable tie is therefore achieved even under strong tightening forces.

What is claimed is:

1. A device in a cable tie comprising an elongated tie part of certain width and thickness, which at one end has an elongated insertion part of lesser width than the tie part and at its other end has a locking head with, on the one hand, a through-opening intended for the tie part and having a width substantially the same as the tie part but a height greater than the thickness of the tie part, and on the other, in one transverse wall of the opening, a groove-shaped recess, the width of which is such that it allows the insertion part to be inserted into the opening via the recess forming a tie loop, interacting members being provided on the tie part and in the locking head that are designed by positive interlocking engagement with one another to lock the tie part relative to the locking head, and pin-shaped projections pointing towards the through-opening being provided at each edge of the recess, characterised in that the tie part has grooves running along its respective edges, which grooves are designed to engage with the free end of the respective projection when the tie part is inserted into the opening.

* * * * *